US005840133A

United States Patent [19]

Takahashi

[11] Patent Number: 5,840,133

[45] Date of Patent: Nov. 24, 1998

[54] PERMANENT MAGNET

[76] Inventor: Yoshiaki Takahashi, Room No. 206 Arisukawa Residence 14-1, 5-Chome, Minamiazabu Monato-ku, Tokyo, Japan

[21] Appl. No.: 776,652

[22] PCT Filed: Jun. 6, 1996

[86] PCT No.: PCT/JP96/01544

§ 371 Date: Feb. 7, 1997

§ 102(e) Date: Feb. 7, 1997

[87] PCT Pub. No.: WO96/42093

PCT Pub. Date: Dec. 27, 1996

[30] Foreign Application Priority Data

Jun. 8, 1995 [JP] Japan ..... H07-274951

[51] Int. Cl.[6] ..... H01F 1/053

[52] U.S. Cl. ..... 148/301; 148/104; 148/101

[58] Field of Search ..... 148/301, 104, 148/101, 102; 420/83

[56] References Cited

U.S. PATENT DOCUMENTS

| | | | |
|---|---|---|---|
| 4,135,953 | 1/1979 | Nagel et al. | 148/301 |
| 4,929,275 | 5/1990 | Bogatin | 148/301 |
| 5,211,770 | 5/1993 | Ishiguro et al. | 148/302 |

FOREIGN PATENT DOCUMENTS

| | | | |
|---|---|---|---|
| 0 323 125 | 12/1987 | European Pat. Off. . | |
| 0323125 | 7/1989 | European Pat. Off. | 148/301 |
| 60-24339 | 2/1985 | Japan | 148/301 |
| 1-298703 | 1/1989 | Japan . | |
| 3-253001 | 11/1991 | Japan . | |

OTHER PUBLICATIONS

Derwent Abstract of Japan 1–278703. Nov. 1989.
English Abstract of EP 323 125 Dec. 28, 1987.
English Abstract of JP 3–253001 Nov. 12, 1991.

*Primary Examiner*—John Sheehan
*Attorney, Agent, or Firm*—Oblon, Spivak, McClelland, Maier & Neustadt, P.C.

[57] ABSTRACT

A permanent magnet of a magnetically anisotropic sinter based on Fe—Mn—R, R representing one or more rare earth elements, which is inexpensive and superior in the low temperature characteristic and which consists, on the basis of atomic percent, of 5–35% of one or more rare earth elements R selected among Yb, Er, Tm and Lu, 1–25% of Mn and the rest of substantially of Fe, characterized in that a part of Fe is replaced by 50 atom. % or less (excluding zero %), based on the entire alloy structure, of Co.

20 Claims, 10 Drawing Sheets

PERMANENT MAGNET

FIELD OF THE INVENTION

The present invention relates to an improvement of a permanent magnet, especially the one based on Co-containing Fe—Mn—R, to be served for electric and electronic elements which are very important to be used in wide fields ranging from household electric appliances to peripheral and terminal equipments of large computers.

BACKGROUND OF THE INVENTION

In recent years, demands for miniaturization and high efficiency for electric and elecronic devices and instruments have grown progressively, necessitating the permanent magnets for delivering energy in such devices and instruments to reveal more higher performances.

Presently representative permanent magnets are those of magnetically anisotropic sinters based on alnico, hard ferrite and samacoba as well as Fe—B—R(Nd).

It has been approved that such recent magnets as those based on Fe—B—Nd etc. exhibit inferior temperature characteristics and are not applicable to instruments in automobile and so on.

In the market, there is a demand for a permanent magnet of low price exhibiting superior temperature characteristics and, in particular, there is wanted a permanent magnet which exhibits markedly higher magnetic characteristics, as compared with conventional magnets, and also better temperature characteristics and is applicable mainly to products with high added values, such as generator-motor and the like.

DISCLOSURE OF THE INVENTION

The present invention has been reached from a sound research based on the above-mentioned circumstances and the invention consists in a permanent magnet of a magnetically anisotropic sinter based on Fe—Mn—R, wherein R represents one or more rare earth elements, consisting, on the basis of atomic percent, of 5–35% of one or more rare earth elements R selected among Yb, Er, Tm and Lu, 1–25% of Mn and the rest of substantially of Fe, characterized in that a part of Fe is replaced by 50 atom. % or less (excluding zero %), based on the entire structure, of Co. Here, it is particularly preferable, that it consists, on the basis of atomic percent, of 10–30% of R (wherein at least 50 atom. % of R are composed of at least one of Yb and Tm), 1–20% of Mn and the rest of substantially of Fe, wherein a part of Fe is replaced by 40% or less (excluding zero %) of Co, based on the entire alloy structure.

According to the present invention, there is provided also a permanent magnet of a magnetically anisotropic sinter based on Fe—Mn—R, wherein R represents one or more rare earth elements, consisting, on the basis of atomic percent, of 4–30%, in the total, of one or more rare earth elements R selected among Yb, Er, Tm, Lu and Y and one or more elements selected among Nd, Pr, Dy, Ho, Tb, La, Ce, Pm, Sm, Eu and Gd, 1–25% of Mn and the rest of substantially of Fe, characterized in that a part of Fe is replaced by 50% or less (excluding zero %), based on the entire alloy structure, of Co. Here, it is particularly preferable, that it consists, on the basis of atomic percent, of 10–30% of R (wherein at least 50 atom. % of R are composed of at least one of Yb and Tm), 1–20% of Mn and the rest of substantially of Fe, wherein a part of Fe is replaced by 40% or less (excluding zero %), based on the entire alloy structure, of Co.

It has, in general, been recognized that there are two kinds of Co-containing Fe alloys, namely, those in which the Curie point (Tc) increases with increasing content of Co, on the one hand, and those in which the Curie point decreases with incresing content of Co, on the other hand.

In the course of progress of the replacement of Fe content of the sinter of magnetically anisotropic permanent magnet based on Fe—Mn—R according to the present invention by Co, Tc of the resulting alloy will at first increase with the increase of Co content until it reaches a maximum at about a ½-replacement of the Fe content, namely at around R(Fe 0.5, Co 0.5)$_3$, before it decreases thereafter. In the case of $Fe_2Mn$ alloy, the Tc will simply increase with the progress of the replacement of Fe by Co.

As for the replacement of Fe of Fe—Mn—R alloys by Co, it was made clear that the Tc of the alloy will increase steeply at first and then decrease gradually with the increase in the Co content, as shown in FIG. 1.

For the alloys based on Fe—Mn—R, similar tendencies are confirmed in accordance with the sort of R. Here, even a small amount (for example, 0.1–1 atomic percent) of replacement of Fe by Co will be effective for increasing the Tc and, thus, as seen in FIG. 1 exemplified for alloys (80-X)Fe—XCo—10Mn—20Yb, any alloy having every voluntary Tc can be obtained by adjusting X.

Thus, according to the present invention, a novel sintered alloy of high magnetic anisotropy for a permanent magnet based on Fe—Co—Mn—R having a Co content of 50 atomic percent or less is provided by replacing a part of Fe of a sintered alloy based on Fe—Mn—R by Co.

THE BEST MODE FOR EMBODYING THE INVENTION

Below, the present invention is described by way of Examples, wherein the scope of the invention does not restricted by these Examples

EXAMPLES

Figure 1:
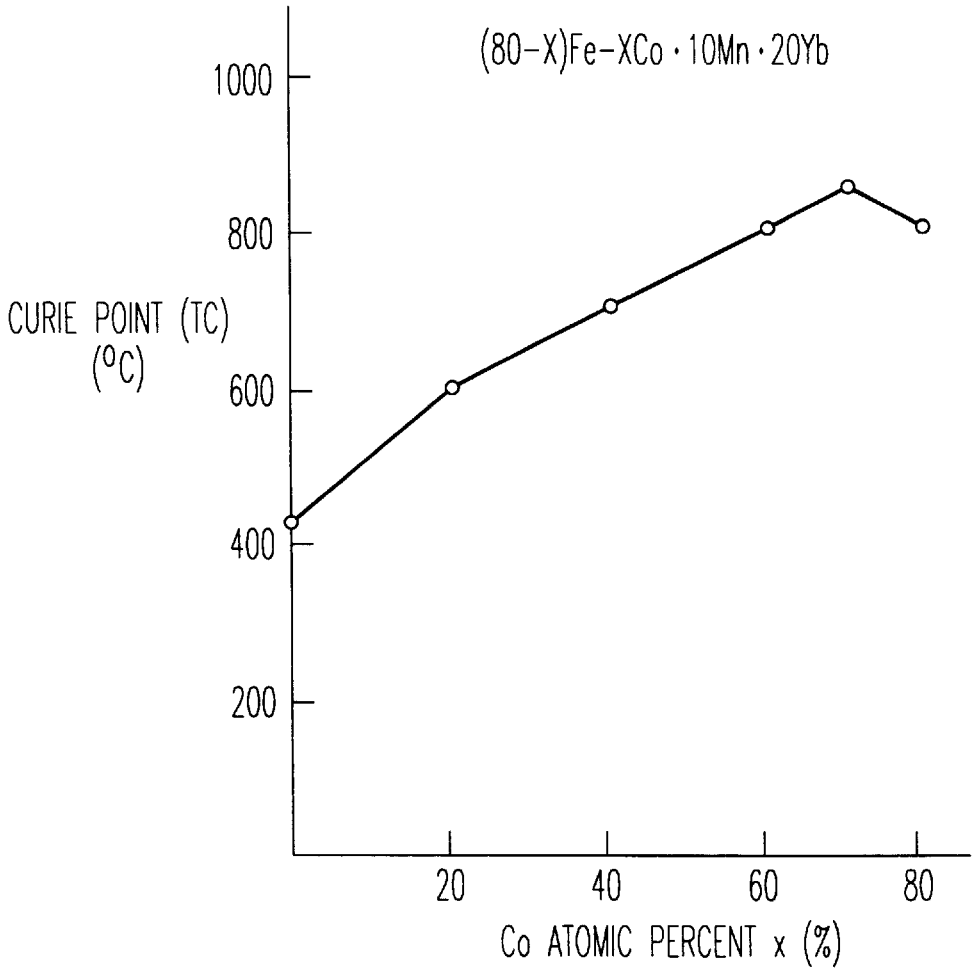
FIG. 1 is a graph showing the relationship between the Co content (abscissa, in atomic percent) and the Curie point (Tc) for a series of alloys of (80-X)Fe—XCo—10Mn—20Yb.

As a representative example, a series of alloys based on (80-X)Fe—XCo—10Mn—20Yb with varying values for X obtained by replacing a part of Fe of an alloy of 80Fe—10Mn—20Yb by Co were examined for the variation of Curie point by altering the value X within the range of from zero to 80, wherein the results were as given in the graph of FIG. 1. Each of the sample alloys was prepared by the following procedures:

(1) Alloy was produced from starting materials of electrolytic iron having a purity of 99.9% by weight, a powdery manganese with a purity of 99.9% by weight, a rare earth metal R with a purity of 99.7% by weight (impurities consist mainly of other rare earth elements) and electrolytic cobalt with a purity of 99.9% by weight, by melting these starting metals in a high-frequency crucible and casting the resulting melt in a water-cooled copper mold.

(2) The resulting cast alloy was crushed on a stamping mill with $N_2$-purge up to a particle size of 35-mesh pass, whereupon the so-crushed alloy was milled for 3 hours on a ball mill also with $N_2$-purge into a powder (average particle size of 3–10 pm).

(3) The resulting powder was press-compacted (at 2 t/cm$^2$) by a high magnetic field orientation molding (20 kOe).

(4) The resulting compact was sintered at 1,000°–1,200° C. for 1 hour under argon atmosphere and was cooled by standing it. A block weighing about 0.1 gram (in a polycrystalline form) was cut from the resulting sinter and the Curie point thereof was determined by VSM in such a manner that a magnetic field of 10 kOe was imposed on the block sample and the change of 4πI by temperature change was observed in a temperature range from 25° C. to 600° C., wherein the temperature at which the 4πI value becomes nearly zero was estimated as the Curie point Tc.

In this series of alloys, the Tc increases steeply with increasing Co content of the alloy, wherein Tc reaches 600° C. or higher for alloys having Co contents of 20% and higher.

The results are given in Table 1 below as well as in FIGS. 1 to 10. In Table 1, various magnetic characteristics of the sample alloys at room temperature are also recited. In most alloys, the coercive force iHC decreases with the increase in the Co content, while BH(max) increases due to the increase in the angularity of the demagnetization curve and in the Br value. However, if the replacement of iron with cobalt proceeds excessively, the decrease in the coercive force iHC goes beyond the tolerable limit, so that the maximum Co content is settled at 50 atomic percent of the entire alloy structure, in order to achieve the condition iHC≧1 kOe for a permanent magnet.

Figure 2:
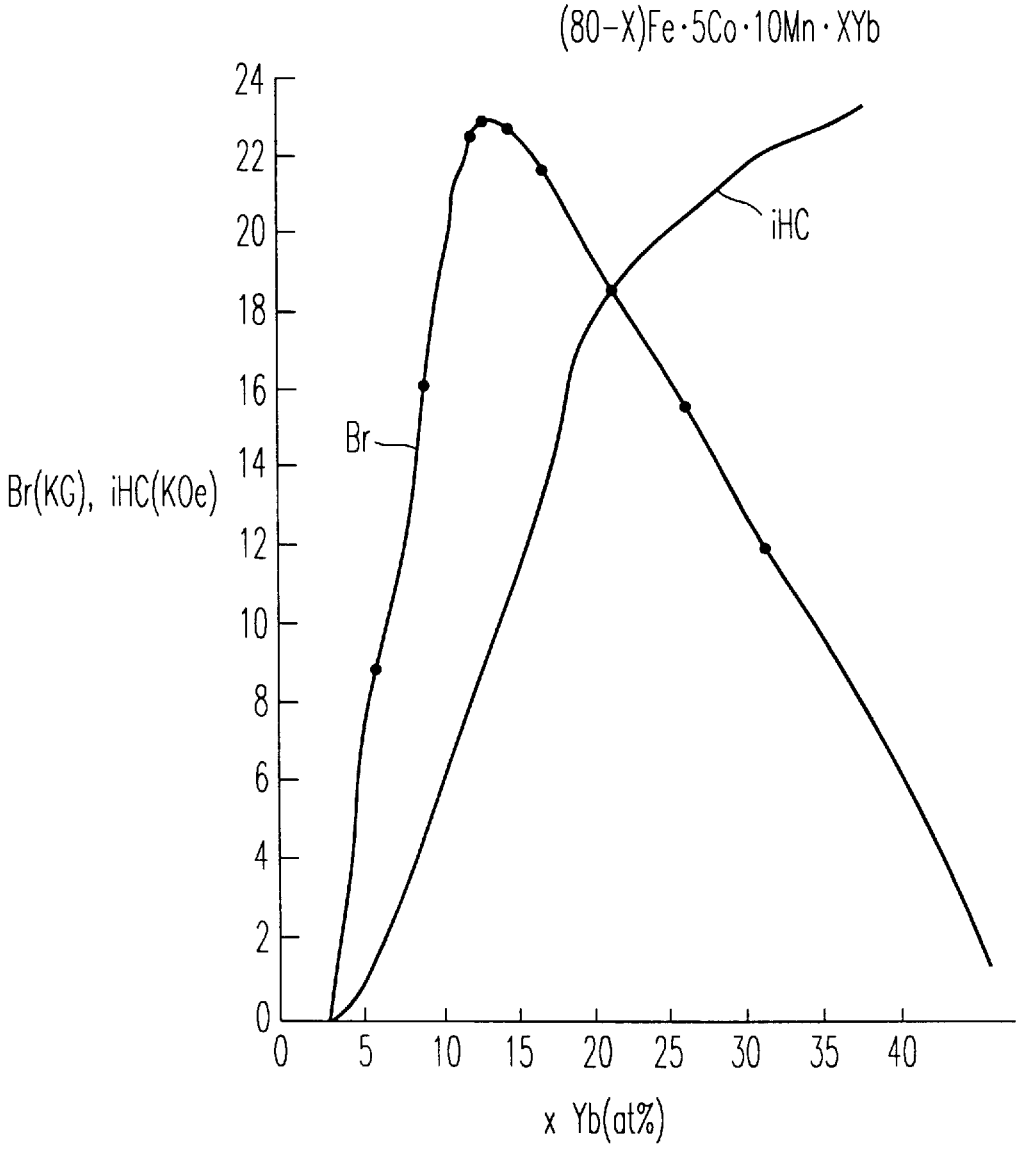
FIG. 2 is a graph showing the relationship between the Yb content (abscissa, in atomic percent) and the coersive force iHC or Br for a series of alloys of (80-X)Fe—5Co—10Mn—XYb.
Figure 3:
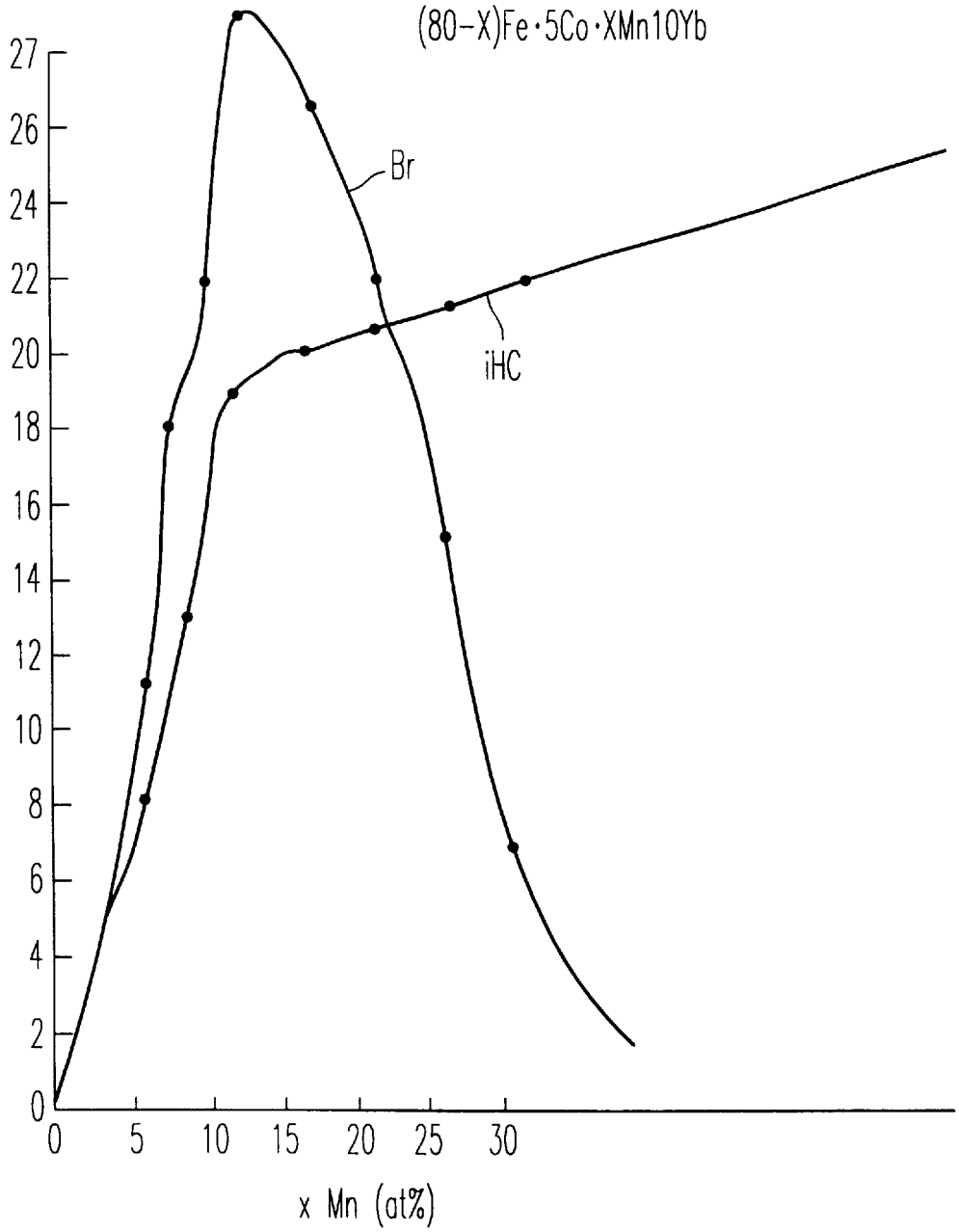
FIG. 3 is a graph showing the relationship between the Mn content (abscissa, in atomic percent) and the coercive force iHC or Br for a series of alloys of (80-X)Fe—5Co—XMn—10Yb.
Figure 4:
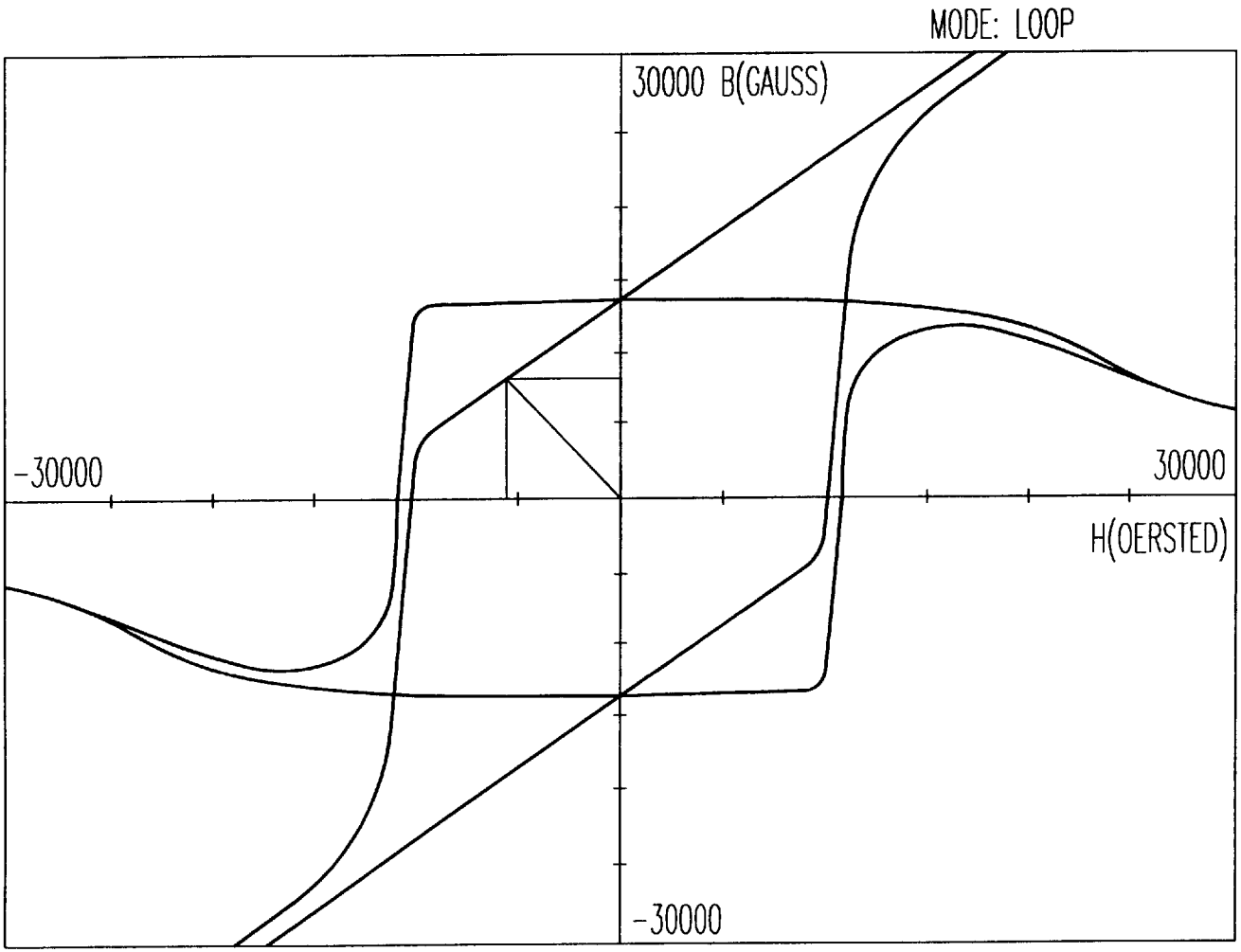
FIG. 4 shows a BH-demagnetization curve for the sample No. 1 of Table 1 (BH-tracer curve 1).
Figure 5:
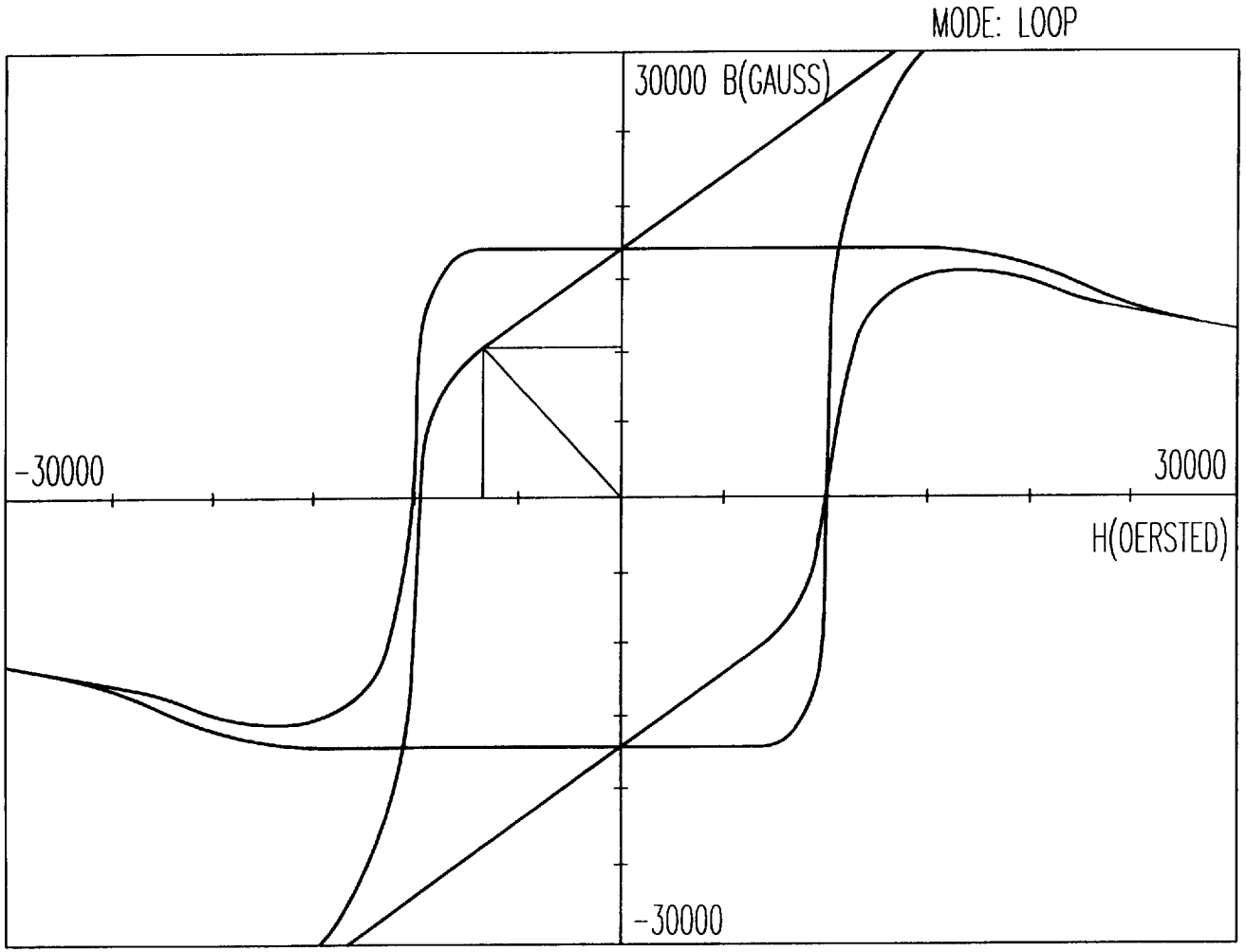
FIG. 5 shows a BH-demagnetization curve for the sample No. 2 of Table 1 (BH-tracer curve 2).
Figure 6:
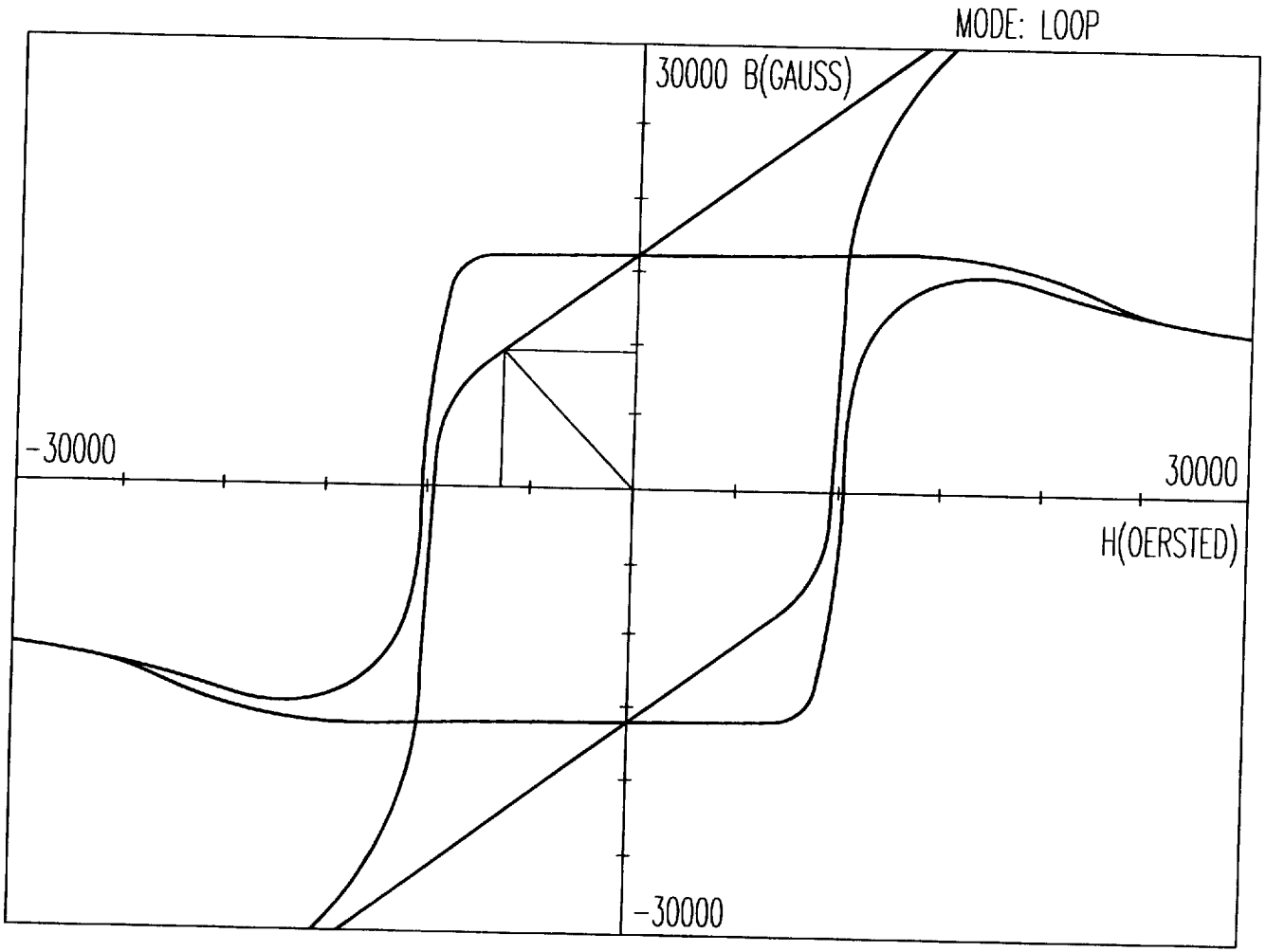
FIG. 6 shows a BH-demagnetization curve for the sample No. 8 of Table 1 (BH-tracer curve 3).
Figure 7:
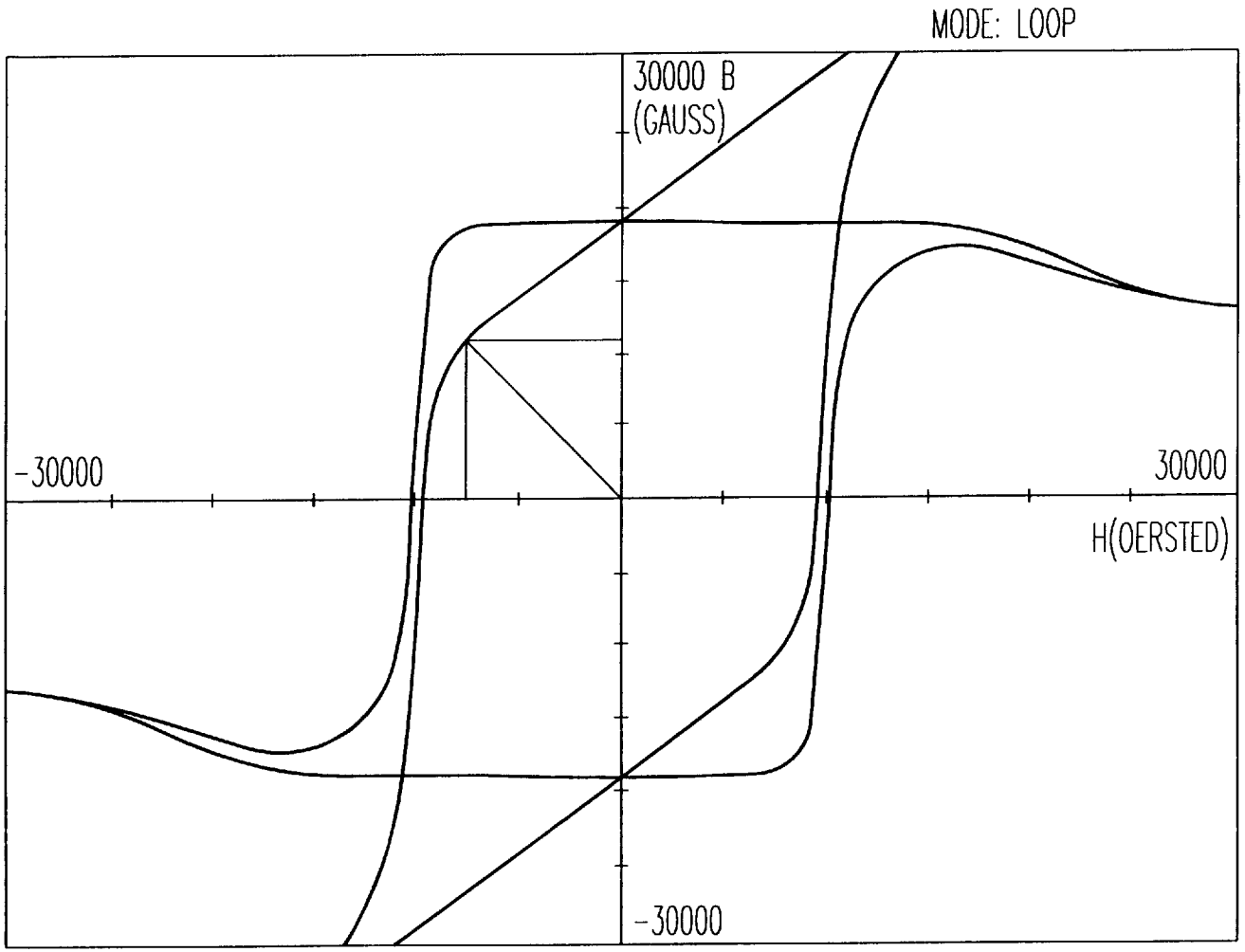
FIG. 7 shows a BH-demagnetization curve for the sample No. 9 of Table 1 (BH-tracer curve 4).
Figure 8:
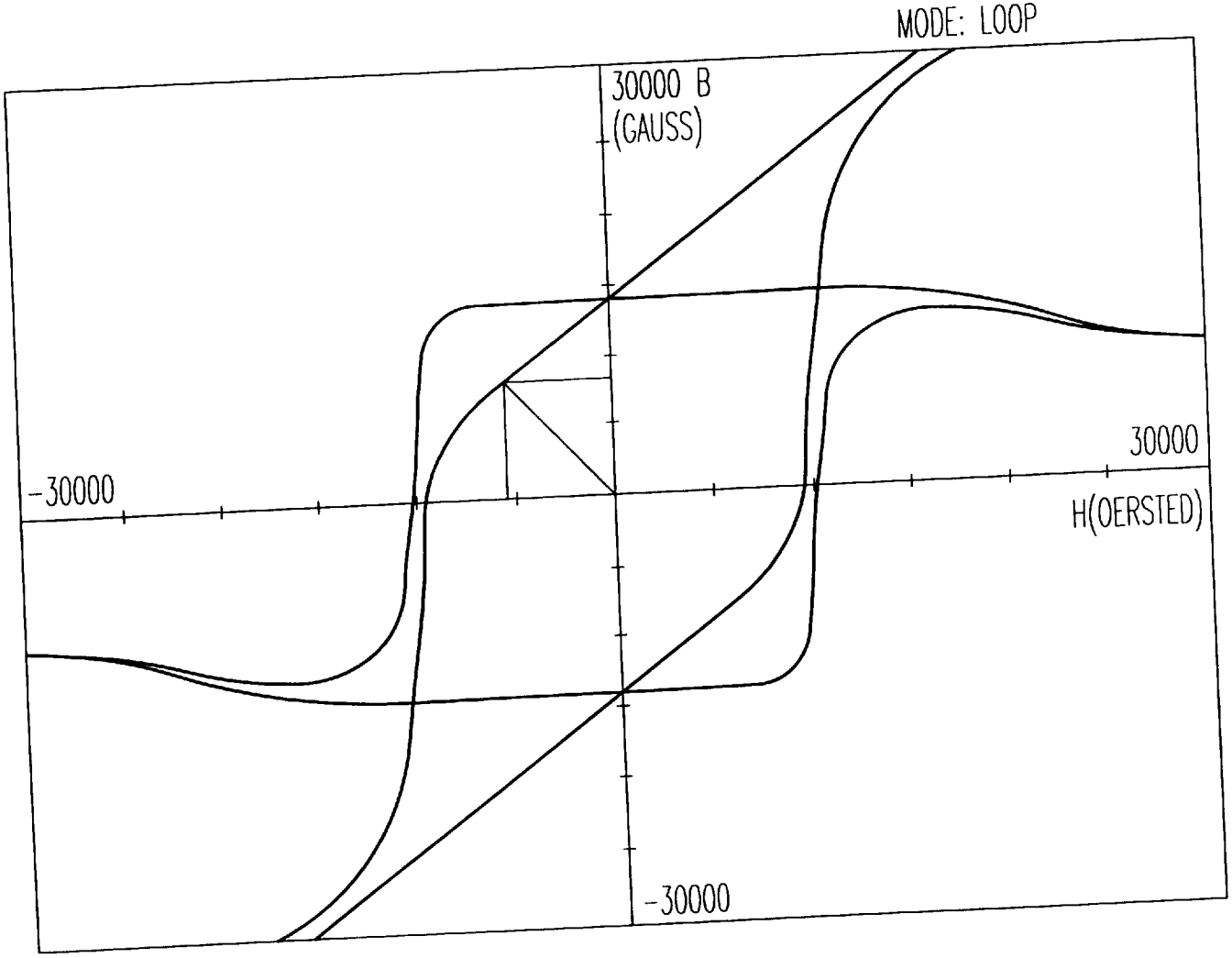
FIG. 8 shows a BH-demagnetization curve for the sample No. 24 of Table 1 (BH-tracer curve 5).
Figure 9:
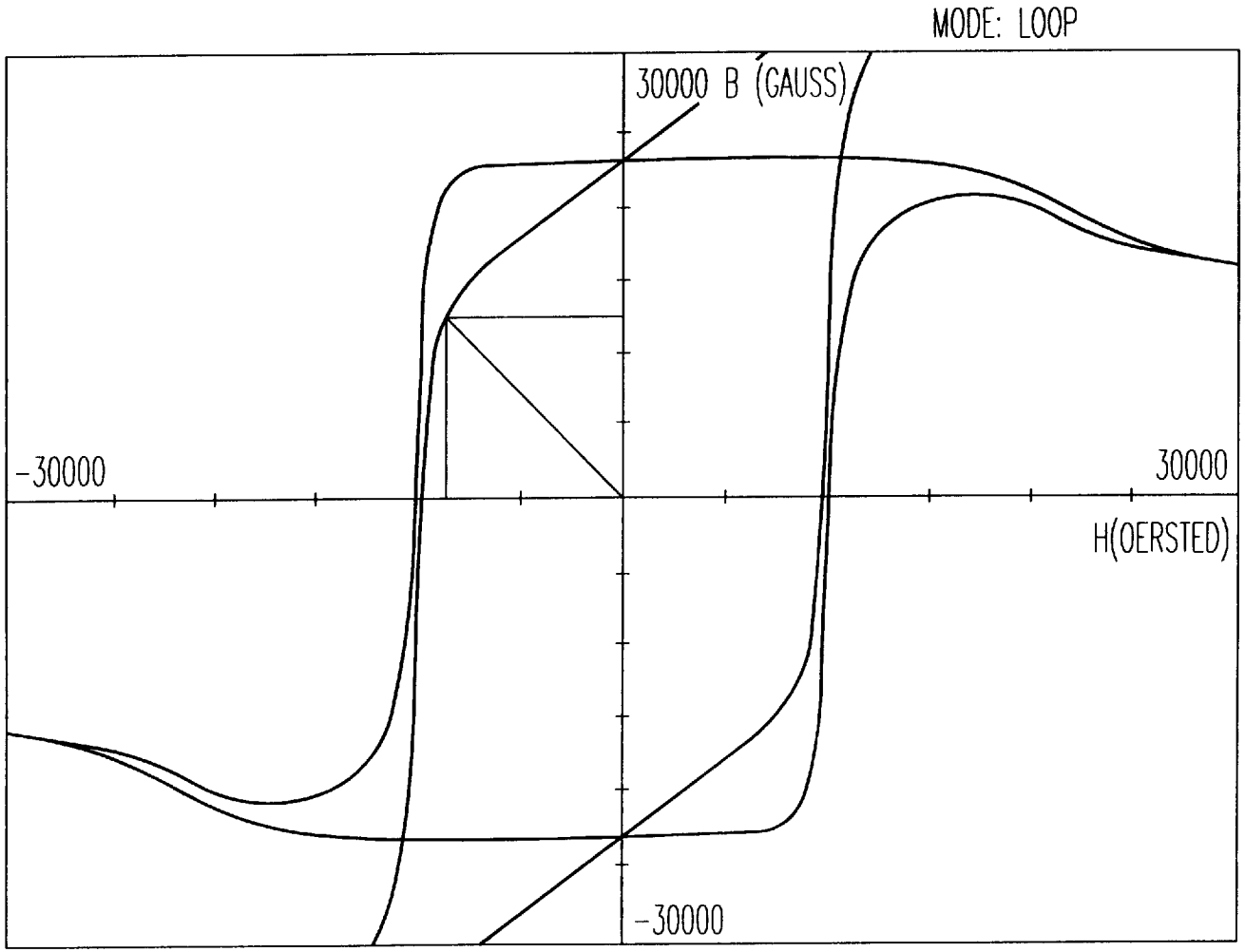
FIG. 9 shows a BEH-demagnetization curve for the sample No. 25 of Table 1 (BH-tracer curve 6).
Figure 10:
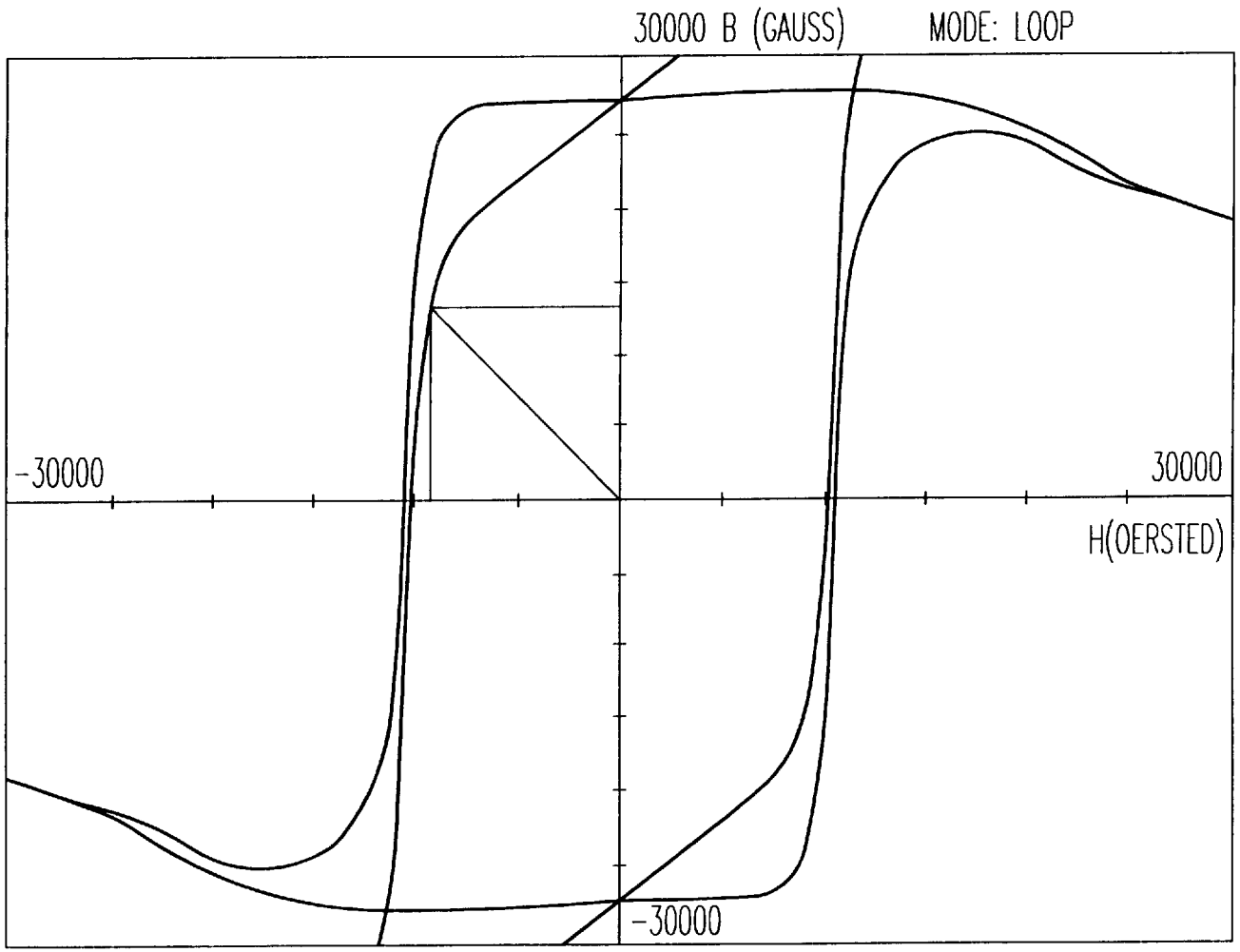
FIG. 10 shows a BH-demagnetization curve for the sample No. 26 of Table 1 (BH-tracer curve 7).

The upper and lower limits of Mn content and the upper limit of Yb content are settled as given previously from the results as given in Table 1 and in FIGS. 2 and 3.

The novel permanent magnet based on Fe—Mn—R according to the present invention has fundamentally improved temperture characteristics and a considerably higher Curie point (Tc) of around 420° C. as compared with that of 220° C. of the conventional magnet based on Fe—B—R and, thus, the inventive magnet reveals an advantageous feature comparable to or even surpassing the conventional magnets based on alnico and R—Co.

TABLE 1

| Alloy Composition (atom. %) | Br-Temp. Coeff. (%/°C.) | iHC (kOe) | kG | $BH_{max}$ | BH curve |
|---|---|---|---|---|---|
| 1 Fe—4Mn—20Yb | 0.07 | 10.6 | 13.5 | 44.9 | 1 |
| 2 Fe—10Mn—20Yb | 0.07 | 17.6 | 10.0 | 72.2 | 2 |
| 3 Fe—17Mn—20Yb | 0.08 | 8.5 | 12.1 | 34.1 | |
| 4 Fe—17Mn—30Yb | 0.09 | 10.0 | 10.1 | 30.0 | |
| 5 Fe—20Co—30Yb | — | 0 | 0 | 0 | |
| 6 Fe—10Co—19Mn—5Nd | — | 0 | 0 | 0 | |
| 7 Fe—60Co—10Mn—20Yb | 0.02 | 5.2 | 8.5 | 25.6 | |
| 8 Fe—10Co—10Mn—20Yb | 0.03 | 10.2 | 16.5 | 63.6 | 3 |
| 9 Fe—20Co—10Mn—20Yb | 0.03 | 19.0 | 10.0 | 82.4 | 4 |
| 10 Fe—30Co—10Mn—29Yb | 0.03 | 17.0 | 10.0 | 72.2 | |
| 11 Fe—40Co—10Mn—20Yb | 0.03 | 10.0 | 12.0 | 40.1 | |
| 12 Fe—50Co—10Mn—20Yb | 0.03 | 4.5 | 11.8 | 23.8 | |
| 13 Fe—15Co—17Mn—20Yb | 0.06 | 7.2 | 9.0 | 19.3 | |
| 14 Fe—30Co—17Mn—20Yb | 0.04 | 7.4 | 6.3 | 17.2 | |
| 15 Fe—20Co—10Mn—10Tm—3Ce | 0.04 | 7.1 | 10.5 | 25.0 | |
| 16 Fe—20Co—12Mn—14Ce | 0.03 | 6.3 | 10.5 | 23.0 | |
| 17 Fe—15Co—17Mn—8Yb—5Ce | 0.03 | 7.4 | 9.0 | 18.8 | |
| 18 Fe—20Co—10Mn—3Sm—5Ce | 0.04 | 7.2 | 10.0 | 21.3 | |
| 19 Fe—10Co—15Mn—8Yb—7Y | 0.03 | 10.1 | 10.0 | 29.6 | |
| 20 Fe—10Co—14Mn—7Yb—3Tm—5Lu | 0.04 | 11.0 | 7.8 | 18.4 | |
| 21 Fe—30Co—17Mn—28Yb— | 0.05 | 12.5 | 7.5 | 15.4 | |
| 22 Fe—10Co—10Mn—12Yb—6Dy | 0.04 | 7.8 | 10.0 | 20.1 | |
| 23 Fe—10Co—10Mn—12Yb—6Ho | 0.05 | 10.1 | 10.3 | 29.6 | |
| 24 Fe—5Co—10Mn—20Yb | 0.05 | 10.1 | 14.0 | 47.5 | 5 |
| 25 Fe—5Co—10Mn—15Yb | 0.05 | 9.7 | 22.9 | 111.7 | 6 |
| 26 Fe—5Co—10Mn—19Yb | 0.05 | 10.1 | 27.5 | 144.7 | 7 |

I claim:

1. A sintered anisotropic permanent magnet, comprising an Fe—Mn—R alloy, said permanent magnet containing:

5–35 atomic % R, wherein R is at least one member selected from the group consisting of Yb, Er, Tm and Lu, 1–25 atomic % Mn, Fe and Co, in an atomic ratio of Co:Fe of 0.1–50%.

2. A sintered anisotropic magnet, comprising an Fe—Mn—R alloy, said permanent magnet containing:

4–30 atomic % R, wherein R is at least one member selected from the group consisting of Yb, Er, Tm, Lu, Y, Nd, Pr, Dy, Ho, Tb, La, Ce, Pm, Sm, Eu and Gd, 1–25 atomic % Mn, Fe and Co, in an atomic ratio of Co:Fe of 0.1–50%.

3. The permanent magnet of claim 1, wherein said permanent magnet contains 10–30 atomic % R.

4. The permanent magnet of claim 1, wherein at least 50 atomic % of said R is at least one member selected from the group consisting of Yb and Tm.

5. The permanent magnet of claim 1, wherein said permanent magnet contains 1–20 atomic % Mn.

6. The permanent magnet of claim 1, wherein said permanent magnet contains Fe and Co in an atomic ratio of Co:Fe of 0.1–40%.

7. The permanent magnet of claim 1, wherein said Fe—Mn—R alloy contains at least 5 atomic % Co.

8. The permanent magnet of claim 1, wherein said permanent magnet contains Fe and Co in an atomic ratio of Co:Fe of 0.5–50%.

9. The permanent magnet of claim 1, wherein said permanent magnet has a Tc of at least 420° C.

10. A method of making the permanent magnet of claim 1, comprising:

sintering a press-compacted powder.

11. The permanent magnet of claim 1, wherein said permanent magnet contains 10–30 atomic % R, 50 atomic % of said R is at least one member selected from the group consisting of Yb and Tm, said permanent magnet contains 1–20 atomic % Mn, and said permanent magnet contains Fe and Co in an atomic ratio of Co:Fe of 0.1–40%.

12. The permanent magnet of claim 2, wherein said permanent magnet contains 10–30 atomic % R.

13. The permanent magnet of claim 2, wherein at least 50 atomic % of said R is at least one member selected from the group consisting of Yb and Tm.

14. The permanent magnet of claim 2, wherein said permanent magnet contains 1–20 atomic % Mn.

15. The permanent magnet of claim 2, wherein said permanent magnet contains Fe and Co in an atomic ratio of Co:Fe of 0.1–40%.

16. The permanent magnet of claim 2, wherein said Fe—Mn—R alloy contains at least 5 atomic % Co.

17. The permanent magnet of claim 2, wherein said permanent magnet contains Fe and Co in an atomic ratio of Co:Fe of 0.5–50%.

18. The permanent magnet of claim 2, wherein said permanent magnet has a Tc of at least 420° C.

19. A method of making the permanent magnet of claim 2, comprising:

sintering a press-compacted powder.

20. The permanent magnet of claim 2, wherein said permanent magnet contains 10–30 atomic % R, 50 atomic % of said R is at least one member selected from the group consisting of Yb and Tm, said permanent magnet contains 1–20 atomic % Mn, and said permanent magnet contains Fe and Co in an atomic ratio of Co:Fe of 0.1–40%.

* * * * *

UNITED STATES PATENT AND TRADEMARK OFFICE

CERTIFICATE OF CORRECTION

PATENT NO. : 5,840,133

DATED : November 24, 1998

INVENTOR(S) : Yoshiaki TAKAHASHI

It is certified that error appears in the above-identified patent and that said Letters Patent is hereby corrected as shown below:

On the title page, item [30] Foreign Application Priority Data should be:

--[30] Foreign Application Priority Data

Jun. 8, 1995 [JP] Japan .....H07-166858--

Signed and Sealed this

Fifteenth Day of June, 1999

*Attest:*

*Attesting Officer*

Q. TODD DICKINSON

*Acting Commissioner of Patents and Trademarks*